US005255248A

United States Patent [19]

Goodmon

[11] Patent Number: 5,255,248

[45] Date of Patent: Oct. 19, 1993

[54] TIME LINE WATCH

[76] Inventor: Steven L. Goodmon, H.C.R. 5, Box 1267, Burnet, Tex. 78611

[21] Appl. No.: 896,879

[22] Filed: Jun. 10, 1992

Related U.S. Application Data

[63] Continuation of Ser. No. 630,011, Dec. 19, 1992, abandoned.

[51] Int. Cl.[5] ..... G04B 19/04

[52] U.S. Cl. ..... 368/228; 368/223; 368/108; 368/112; 368/281

[58] Field of Search ..... 368/223-239, 368/70-113

[56] References Cited

U.S. PATENT DOCUMENTS

| | | | |
|---|---|---|---|
| 1,455,482 | 5/1923 | Gleason | 368/10 |
| 1,790,359 | 1/1931 | Wier | 368/238 |
| 3,427,800 | 2/1969 | Blum | 368/10 |
| 3,475,982 | 11/1969 | Wessel | 368/10 |
| 3,505,808 | 4/1970 | Eschle | 368/10 |
| 3,747,324 | 7/1973 | Foufounis | 368/10 |
| 3,874,164 | 4/1975 | Bell | 368/10 |

*Primary Examiner*—Bernard Roskoski
*Attorney, Agent, or Firm*—Nixon & Vanderhye

[57] ABSTRACT

A watch is disclosed herein having a case mounting a time-keeping mechanism with hour and minute hands movable across the face of a numbered dial. A time line hand is included, settable by pushbutton to a start position superimposed with the position of the minute hand whereby angular displacement of the minute hand as it moves away from the time line hand establishes elapsed time of an event. A rotatable bezel is coaxially disposed with respect to the watch dial which carries an index arrow and a figure thirty situated 180 degrees apart. The time line hand is selectively operable with the arrow marking of the bezel for reading "count down" time for an event.

1 Claim, 1 Drawing Sheet

FIG. 1
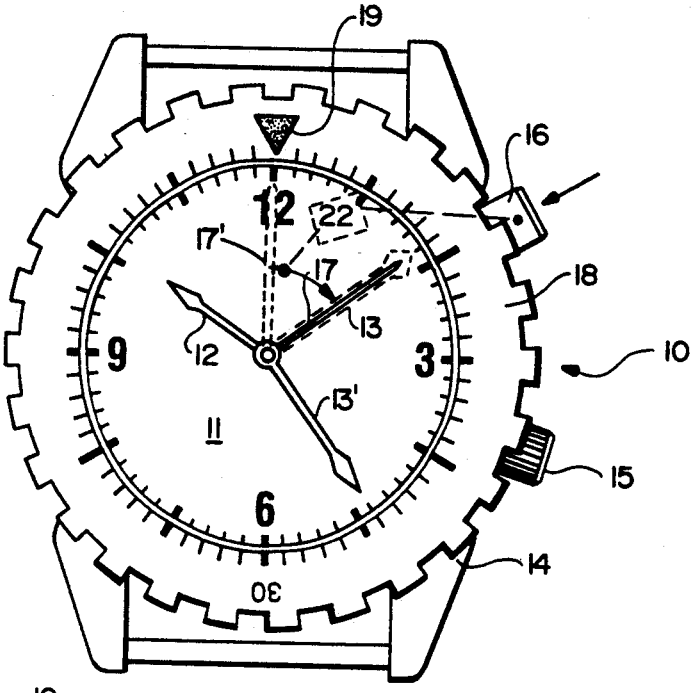
FIG. 2
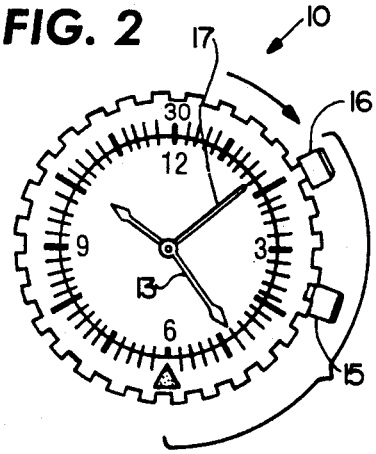
FIG. 4
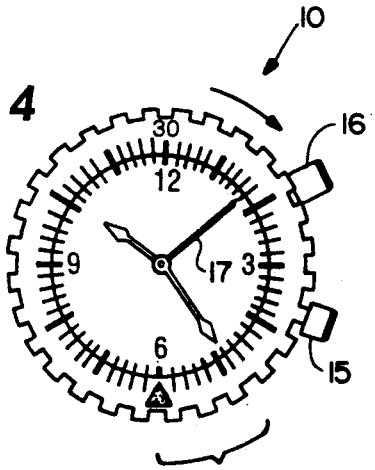
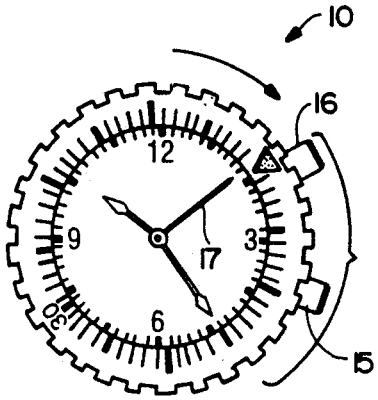
FIG. 3

TIME LINE WATCH

This is a continuation of application Ser. No. 07/630,011, filed Dec. 19, 1992, now abandoned.

BACKGROUND OF THE INVENTION

1. Field of the Invention

The present invention relates to the field of timepieces, and more particularly to a novel dial watch having a special time line hand cooperating with the minute hand of the watch for determining elapsed time and countdown time of events.

2. Brief Description of the Prior Art

In the past, it has been the conventional practice to employ a watch having an hour and minute hand rotatable over a dial face provided with a plurality of spaced-apart time markings such that the angular position between the hour and minute hand determines time. In addition, second hands are often employed for the determination of smaller time increments and in more sophisticated watches, rotating bezels are employed which are useful in determining start and stop conditions for the timed events. Such a watch is disclosed in U.S. Pat. No. 3,475,902.

However, many problems and difficulties have been encountered when employing conventional watches with or without bezels that stem primarily from the fact that determination of elapsed time of an event is difficult to establish and it is also difficult to establish countdown time. For both of these events, mental calculations must be made by the timekeeper in order to establish the relationship between the moving hand and the markings on the dial face as well as the bezel itself. For example, there are many uses for stopwatches and their ability to measure in very small increments of time. Furthermore, chronographs are required for celestial and other navigational calculations. Neither the stopwatch nor the chronograph fill a void for applications encountered in everyday events; for example, timing a phone call or how long a certain task will take.

Therefore, a long-standing need has existed to provide a timepiece, such as a dial watch, which will measure events in minutes and show the timekeeper at a glance exactly what time it was when the event started, elapsed time, finish time, and with the use of a bezel, how much time to go or countdown before the event is finished. Such a timepiece is neither a stopwatch nor a chronograph.

SUMMARY OF THE INVENTION

Accordingly, the above problems and difficulties are obviated by the present invention which provides a novel timepiece or watch having a case for mounting a time mechanism operating an hour hand, a minute hand and incorporating spaced markings about the peripheral edge of the dial. A time line hand is included with a pushbutton activator projecting from the watch case and a rotating bezel is coaxially located on the watch case and includes special markings intended for use with the time line hand. The additional time line hand moves, when actuated by the pushbutton, to the location of the minute hand and then remains stationary. The stationary time line hand indicates the beginning of a time segment as the minute hand moves away from the time line hand. The rotating bezel includes an index arrow that can be positioned to the time that an event starts or can be set ahead to the time the event is anticipated to end, the bezel including the unique scale being marked at zero with an arrow and on the opposite side with a "30". The rest of the watch dial bexel is marked in 1, 5 and 10 minute increments. When the index arrow is set at the starting time of the event, elapsed time is shown. When the index arrow on the bezel is set at an ending time, countdown time is automatically shown.

Therefore, it is among the primary objects of the present invention to provide a timepiece which indicates the exact time that an event is started and which is capable of indicating the time elapsing as a minute hand moves away from the exact time the event started.

Yet another object of the present invention is to provide a novel timepiece having a time line hand which is placed in a stationary position with respect to a starting time of an event so that the angular relationship between the stationary hand and a moving minute hand will indicate elapsed time.

Another object of the present invention is to provide a novel timepiece having a rotating bezel with special markings adapted to be aligned with a settable stationary hand, i.e. time line hand, so that movement of the minute hand away from the settable stationary hand provides countdown information for the timekeeper.

Still another object of the present invention is to provide a novel watch having a settable stationary hand operable in conjunction with a rotating bezel with special markings so that both time lapse events can be determined as well as countdown time between the start of the event and the end of the event can be determined.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front elevational view of the novel watch incorporating the line time hand of the present invention;

FIG. 2 is a reduced view of FIG. 1 showing the time line hand and minute hand in a situation employing the bezel to indicate start and finish time for an event as well as elapsed time;

FIG. 3 is a similar view showing the time line hand set for start of event and the minute hand angular displacement indicating elapsed time; and FIG. 4 is a similar view showing the time line hand and minute hand in angularly related position in combination with bezel markers to indicate countdown time to the end of an event.

DESCRIPTION OF THE PREFERRED EMBODIMENT

Referring to FIG. 1, a novel time line watch is indicated in the general direction of arrow 10 which includes an analog dial 11 over which an hour hand 12 and a minute hand 13 move in accordance with a conventional time mechanism enclosed within a watch case 14. A crown 15 is employed for setting the hour and minute hands to the correct time in accordance with conventional procedure. A pushbutton 16 is pushed to activate a time line hand 17 so that it may be set from a nominal rest position 17' (shown in dotted line) to a desired the current time (e.g., as depicted by the dotted line position 13' of the minute hand 13) position as illustrated by solid lines (overlaying position 13') on the dial face 11. Conventional "catch-up hand" systems 22 may be used to effect movement of the time line hand 17 from position 17' to the then current minute hand position 13'in response to pushing the button 16 as noted in U.S. Pat. No. 3,747,324. A pushbutton 16 is employed to activate and move the time line hand in accordance with the arrow showing a direction to depress the button. A rotating bezel 18 is coaxially disposed on the case 14 with the dial 11 and has special markings such as an index arrow 19 on one side of the bezel and on the opposite side of the bezel, a figure "30" is visible. All remaining numbers on the dial arranged in spaced sequence about the peripheral edge are 10 minute marks, 5 minute marks and 1 minute marks. The rotating bezel 18 may be moved to align the index arrow on the bezel with the time marks on the dial face and, through the use of the pushbutton 16, the time line hand may be moved to be aligned with the minute hand.

It is to be further understood that the time line hand 17 is not a second hand and it is intended to be a stationary marker once it has been set to a selected position by the user.

The time line watch 10 shown in FIG. 1 is used in a variety of ways. For example, the regular hour hand 12 and the minute hand 13 show the time to be 10:09. The minute hand 13 is illustrated in broken lines to illustrate this time sequence. The user may time an event starting at this instant. The user pushes the button 16 and releases the time line hand 17 for movement in short jumps or increments to the position of the minute hand 13 and remains in this position at 10:09. In the illustration, the time line hand 17 is superimposed under the initial broken line showing of the minute hand 13. Thus, the event is known to the user to end at 10:30. Therefore, the user moves or rotates the bezel 18 so that the index arrow 19 is positioned at 10:30. The setting of the hands and the bezel are shown in FIG. 2, and at a glance, the user is visually exposed to the following information. The event started at 10:09 and ended at 10:30, the time marks 19 on the rotating bezel 18 show an elapsed time of 21 minutes opposite the time line hand 17.

Another way of employing the time line watch 10 in FIG. 1 is illustrated in FIG. 3 wherein pushbutton 16 is actuated to move the time line hand 17 to the position of the minute hand 13 and remain stationary at 10:09. This event must end promptly at 10:30 as known by the user so that the bezel 18 is rotated until the index arrow 19 is positioned opposite the 10:30 ending time. The time marks 19 opposite the time line hand 17 show the event will take 21 minutes. As the minute hand 13 advances, the time remaining in minutes is counted down on the time marks 19 on the rotating bezel 18 until the event ends at 10:30.

The bezel 18 and time scale marks 19 are arranged with an index arrow and the number "30" disposed 180 degrees from each other on the face of the bezel so that a unique ability is provided allowing elapsed time to be counted when the minute hand moves away from the index arrow and countdown time when the minute hand moves toward the index arrow, against the time scale marks arranged.

In brief, FIG. 2 shows a reading of 21 minutes elapsed time on the bezel markings from the starting time, indicated by the time line hand and a finish time, indicated by the arrow on the bezel. In FIG. 3, minutes of elapsed time are read on the bezel from the start of an event, as indicated by the alignment of the time line hand with the arrow on the bezel and the position of the minute hand with respect to the time scale on the dial face. In FIG. 4, countdown minutes to the end of the event are read between the opposite ends of the bracket adjacent the bezel between the minute hand and the arrow on the bezel. The time line hand indicates a setting for a 21 minute event which is established between the time line hand and the arrow on the bezel.

In view of the foregoing, it can be seen that the illustrations described above provide examples of the inventive concept showing to the user a slice of time at a glance. The beginning boundary of the time segment is the time line hand 17. When the time line hand is activated by pushing the button 16, the time line hand moves from its initial position pointing at 12:00 o'clock to the position of the minute hand 13 where the time line hand is superimposed beneath the minute hand. While the time line hand marks the beginning edge of the time segment, the moving minute hand shows the advancing edge of the time slice. The widening time slice gradually shows the elapsed time of the event whether it be a phone call or travel time. Another advantage of the stationary time line hand is that it shows what minute after the hour the event started without having to write it down. For example, at take-off time, a pilot can devote his attention to the aircraft and write the take-off time down at a more convenient time in the future. A rotating bezel can add the ability to set the index arrow at the time when the event ends. The index arrow can also be set ahead to an estimated finishing time and the minute hand will be a countdown indicator. Therefore, it can be seen that the inventive concept is a very useful device for gathering time information in many applications. For example, not only what the time was when the telephone rang, but how long a person talks on the telephone.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A time line watch comprising:

a watch case;

a central dial mounted on said case having an analog time scale representing a twelve hour time period visibly carried about the edge marginal region thereof;

an hour hand and a minute hand movably carried for positioning over said dial in sequential alignment with said time scale and coupled to means for positioning said hands about said dial to represent hour and minute in real time;

a time line hand movably carried on said watch case and settable to a selected aligned stationary position with respect to said analog dial scale aligned with the current position of said minute hand and indicative of a starting time for a timed sequence;

pushbutton means carried on said watch case operably coupled to said time line hand for manually positioning said time line about said dial to said stationary position;

a bezel rotatably carried on said watch case in coaxial relationship with said dial;

said bezel having an index arrow indicia and a numerical indicia "30" separated by 180 degrees;

said bezel index arrow indicia and said time line hand cooperatively acting together when in circumferentially offset spaced-apart relationship whereby said time line hand visually indicates said starting time of an event while said bezel index arrow indicia indicates the end of said event and elapsed time is indicated by the real time position of said minute hand with respect to said start of event indication and which indicates the time remaining until the end of said event by the real time position of said minute hand with respect to said bezel arrow indicia;

said bezel index arrow indicia and said time line hand further cooperating together when in radially aligned spaced-apart relationship to visually indicate total event time elapsed between the real time position of said minute hand and said time line hand;

said time line hand being in a selected stationary position during timing of an event while said minute hand moves in angular relationship with respect to said time line hand to represent not only countup elapsed time of said time event but also countdown minutes to the end of the event;

said bezel having an incremental minute scale carried thereon with said index arrow indicia at the beginning of said scale and said "30" numerical indicia at the mid-point of said scale which is otherwise without further numerical indicia;

said time line hand being registerable with a selected increment of said scale to indicate the start of a timed event when said index arrow indicates event completion.

* * * * *